US007229060B2

(12) United States Patent
Collins

(10) Patent No.: US 7,229,060 B2
(45) Date of Patent: Jun. 12, 2007

(54) CLAMP ASSEMBLY

(76) Inventor: Arthur Roy Collins, 1368 Cedar Brook La., Oklahoma City, OK (US) 73170

( * ) Notice: Subject to any disclaimer, the term of this patent is extended or adjusted under 35 U.S.C. 154(b) by 0 days.

(21) Appl. No.: 11/057,655

(22) Filed: Feb. 14, 2005

(65) Prior Publication Data

US 2005/0194512 A1 Sep. 8, 2005

Related U.S. Application Data

(60) Provisional application No. 60/544,406, filed on Feb. 13, 2004.

(51) Int. Cl.
*A47G 33/12* (2006.01)

(52) U.S. Cl. ..... 248/534; 135/16; 135/19; 248/218.4

(58) Field of Classification Search ..... 248/535, 248/514, 515, 516, 536, 538, 539, 534, 218.4, 248/316.1, 291.1; 135/16, 19
See application file for complete search history.

(56) References Cited

U.S. PATENT DOCUMENTS 5,465,932 A * 11/1995 Richter ..... 248/160
5,472,166 A * 12/1995 Wear ..... 248/514
6,089,246 A * 7/2000 Barnes ..... 135/88.06

* cited by examiner

*Primary Examiner*—Ramon O Ramirez
(74) *Attorney, Agent, or Firm*—Dunlap, Codding & Rogers, P.C.

(57) ABSTRACT

A clamp assembly for adjustably attaching a pole to a frame or a support member, the clamp assembly includes an elongated housing having a passageway, a slit in open communication with the passageway for adjusting a diameter of the passageway, a first connector plate extending outwardly from the elongated housing and disposed along a first side of the slit and the second connector plate extending outwardly from the elongated housing disposed along an other side of the slit, and a mounting plate or c- shaped clamp for attaching to the frame or support member respectively, and a locking member for adjustably attaching the elongated housing, the first connector plate and the second connector plate to the mounting plate.

6 Claims, 4 Drawing Sheets

CLAMP ASSEMBLY

The present application claims priority to the following provisional patent applications: CLAM ASSEMBLY, filed on Feb. 13, 2004 and identified by U.S. Ser. No. 60/544,406.

BACKGROUND

1. Field of the Invention

The present invention relates to clamp assemblies and more particularly but not by way of limitation, to clamp assemblies for mounting umbrellas and similar objects having a pole to a frame of an object. In one aspect, the present invention relates to improved clamp assemblies for mounting umbrellas to chairs, golf carts, canoes and the like.

2. Brief Description of Prior Art

Numerous types of clamp assemblies have here before been proposed for clamping one object to another such as c-clamps, substantially u-shaped brackets which function as clamps, straps, pocket-type structures and the like. While such clamp assemblies have been accepted, a need exists for improved clamp assemblies which permit one to readily alter the disposition of the object supported by the clamp assembly relative to the frame or structure of the object to which the clamp assembly is connected. It is to such clamp assemblies that the present invention is directed.

DETAILED DESCRIPTION

Figure 1:
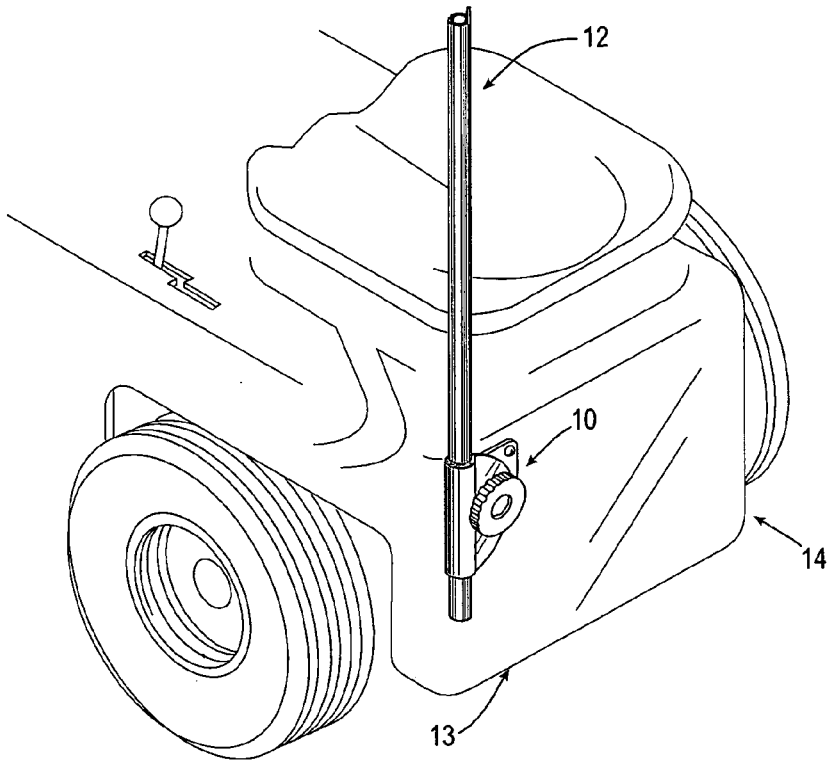
FIG. 1 is a fragmental pictorial representation of a shaft of an umbrella connected to a riding lawn mower utilizing a clamp assembly constructed in accordance with the present invention.

Referring to drawings, and more particularly to FIG. 1, shown therein is a clamp assembly 10 for securing a pole 12 to a frame of an object, such as a frame or body 13 of a riding lawn mower 14. It should be understood that the pole 12 can be the shaft of an umbrella (not shown) or any other accessory desired for use with the riding lawn mower 14. It should also be noted that while the riding lawn mower 14 has been shown as being the object to which the clamp assembly 10 has been attached for securing the pole 12, the structure to which to clamp assembly 10 is secured can be a golf cart, a chair, a folding chair, a table and the like.

Figures 2, 2A:
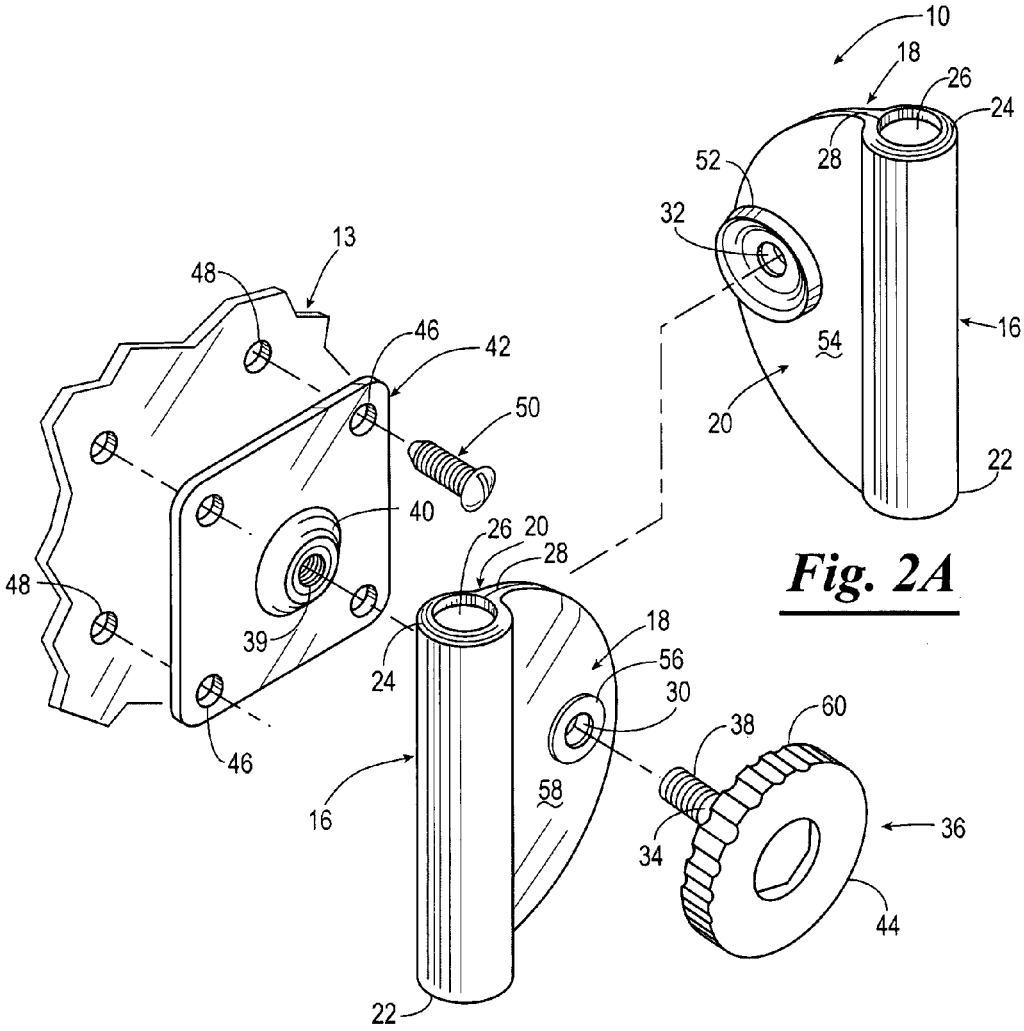
FIG. 2 is an exploded view of the clamp assembly of FIG. 1.
FIG. 2A is the backside of a portion of the clamp assembly of FIG. 1.
Figure 3:
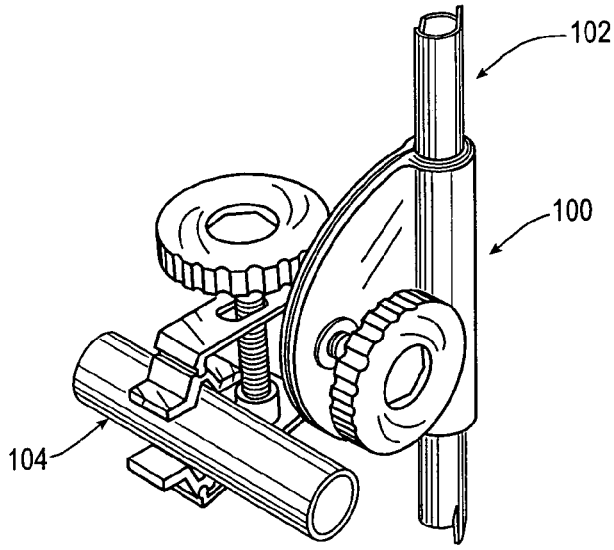
FIG. 3 is a fragmental pictorial representation of a shaft of an umbrella connected to a support member of a canoe utilizing another embodiment of a clamp assembly constructed in accordance with the present invention.
Figure 4:
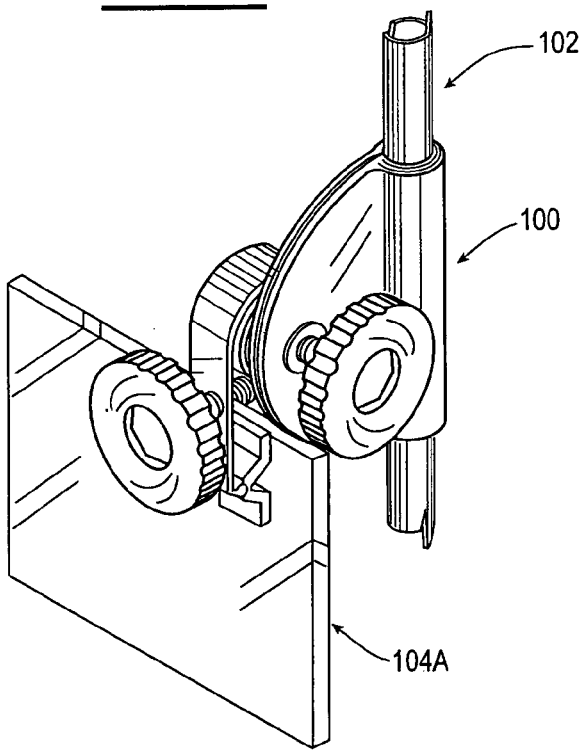
FIG. 4 is a pictorial representation of the clamp assembly of FIG. 3 connected to an upwardly extending planar support member of an object for securing a pole or shaft to the object.

Referring more specifically to FIGS. 2 and 2A, the clamp assembly 10 includes an elongated housing or stanchion 16, a first connector plate 18 and a second connector plate 20. The elongated housing 16 is provided with a first end 22, a second end 24 and a passageway 26 extending between the first and second ends 22 and 24 thereof. The elongated housing 16 is further provided with a slit 28 extending from the first end 22 to the second end 24, the slit 28 openly communicating with the passageway 26 of the elongated housing 16.

The first connector plate 18 extends outwardly from the elongated housing 16 and is disposed along one side of the slit 28. Similarly, the second connector plate 20 extends outwardly from the elongated housing 16 and is disposed along the other side of the slit 28 such that the second connector plate 20 is disposed substantially parallel to the first connector plate 18. Thus, the first and second connector plates 18 and 20, in combination with the slit 28 provided in the elongated housing 16, permit one to increase the diameter of the passageway 26 of the elongated housing 16 within prescribed limits by spreading apart the first and second connector plates 18 and 20 so that the passageway 26 of the elongated housing 16 is enlarged and thus capable of receiving poles of various diameters.

The first connector plate 18 is provided with an aperture 30 extending therethrough (FIG. 2); and the second connector plate 20 is provided with an aperture 32 extending therethrough (FIG. 2A). The apertures 30 and 32 are aligned and the aperture 30 formed in the first connector plate 18 is sized to receive a portion of a shank 34 of a locking member 36 while permitting a threaded distal end portion 38 of the shank 34 to extend therethrough; and the aperture 32 formed in the second connector plate 20 is sized to permit at least a portion of the threaded distal end portion 38 of the shank 34 to extend therethrough for threadable engagement with a threaded bore 39 provided in a friction plate 40 supported on a mounting plate 42 of the clamp assembly 10 as will be described in more detail herein after.

The locking member 36 is also provided with a knob 44 which is connected to the shank 34 whereby the locking member 36 can be selectively rotated in a clockwise direction when securing the first and second connector plates 18 and 20 to the trhreaded bore 39 of the friction plate 40 supported on the mounting plate 42, and whereby the locking member 36 can be selectively rotated in a counter clockwise direction when disconnecting the first and second connector plates 18 and 20 from the threaded bore 39 of the friction plate 40 supported on the mounting plate 42, or for loosening the first and second connector plates 18 and 20 so that the first and second connector plates 18 ands 20 can be rotated so as to alter the position of the pole 12 supported within the passageway 26 of the elongated housing 16 relative to the supporting structure, such as the riding lawn mower 14 to which the clamp assembly 10 is connected.

The mounting plate 42 is shown as having a plurality of apertures 46 which are alignable with a plurality of apertures 48 in the frame or body 13 of the riding lawn mower 14 so that self-tapping screws, such as self-tapping screw 50, can be treadably disposed through the aligned apertures 46 and 48 in the mounting plate 42 and in the frame or body 13 of the riding lawn mower 14, respectively, for securing the mounting plate 42 to the frame or body 13 of the riding lawn mower 14. It should be understood that the present invention is not limited to the use of self-tapping screws for connecting the mounting plate to the frame or body 13 of the riding lawn mower 14 and any suitable mechanism can be employed.

For example, the mounting plate 42 could be bonded to the frame or body 13 with an adhesive or by welding; or the mounting plate 42 could be formed as a part of the frame or body 13; or the mounting plate 42 could be connected to the frame or body 13 via a plurality of bolts and nuts, clamps and the like.

As previously stated, the interconnection of the first and second connector plates 18 and 20 to the mounting plate 42 permits the disposition of the elongated housing 16, and thus the pole 12 connected thereto, to be varied relative to the frame or body 13 of the riding lawn mower 14. In order to stabilize the first and second connector plates 18 and 20 on the friction plate 40 provided on the mounting plate 42, the second connector plate 20 is provided with a friction bushing plate 52 on an outwardly disposed side 54 thereof such that the friction bushing plate 52 extends about the aperture 32 in the second connector plate 20. The friction bushing plate 52 is sized and configured to matingly receive the friction plate 40 provided on the mounting plate 42 so as to enhance a secure connection between the first and second connector plates 18 and 20 and the mounting plate 42 when the locking member 36 is disposed through the apertures 30 and 32 of the first and second connector plates 18 and 20 and is threadably connected to the friction plate 40 via the threaded bore 39 provided in the friction plate 40.

To facilitate gripping of the knob 44 of the locking member 36 and to prevent frictional binding between the knob 44 and the first connector plate 18, the first connector plate 18 is provided with a shoulder 56 formed on an outwardly disposed side 58 of the first connector plate 18 such that the shoulder 56 extends about the aperture 30 in the first connector plate 18. Thus, when the locking member 36 is connected to the friction plate 40, a lower surface 60 of the knob 44 is disposed a distance from the outwardly disposed side 58 of the first connector plate 18.

Figure 5:
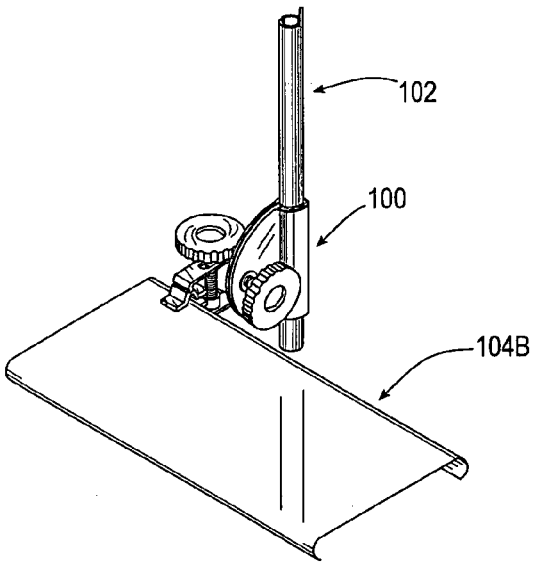
FIG. 5 is a pictorial representation of the clamp assembly of FIG. 3 connected to a horizontally disposed support member of an object for securing a pole or shaft to the object.

Referring now to FIGS. 3–6A, another embodiment of a clamp assembly 100 constructed in accordance with the present invention is illustrated. The unique construction of the clamp assembly permits to the clamp assembly to connect a pole 102, such as a shaft of an umbrella, to various types of objects, such as a support member or brace 104 of a canoe (FIG. 3), or an upwardly extending support member 104A (FIG. 4), or a horizontally disposed support member 104B (FIG. 5).

Figure 6:
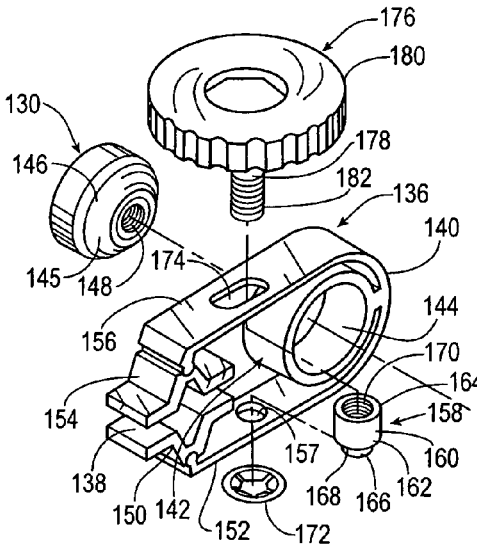
FIG. 6 is an exploded view of the clamp assembly of FIGS. 3–5.
Figure 6A:
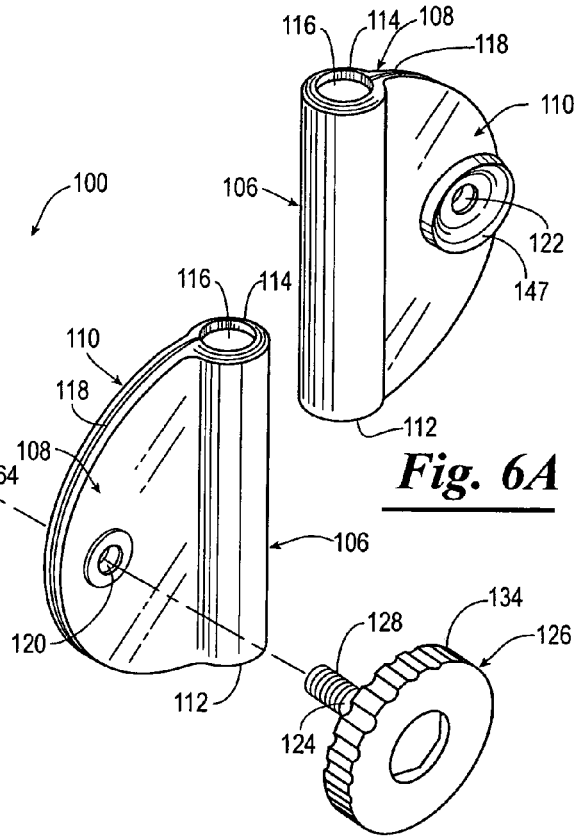
FIG. 6A is a backside of the portion of the clamp assembly of FIG. 3.

Referring more specifically to FIGS. 6 and 6A, the clamp assembly 100 includes an elongated housing or stanchion 106, a first connector plate 108 and a second connector plate 110. The elongated housing 106 is provided with a first end 112, a second end 114 and a passageway 116 extending between the first and second ends 112 and 114 thereof. The elongated housing 106 is further provided with a slit 118 extending from the first end 112 to the second end 114, the slit 118 openly communicating with the passageway 106 of the elongated housing 106.

The first connector plate 108 extends outwardly from the elongated housing 106 and is disposed along one side of the slit 118. Similarly, the second connector plate 110 extends outwardly from the elongated housing 106 and is disposed along the other side of the slit 118 such that the second connector plate 110 is disposed substantially parallel to the first connector plate 108. Thus, the first and second connector plates 108 and 110, in combination with the slit 118 provided in the elongated housing 106, permit one to increase the diameter of the passageway 116 of the elongated housing 106 within prescribed limits by spreading apart the first and second connector plates 108 and 110 so that the passageway 116 of the elongated housing 106 is enlarged and thus capable of receiving poles of various diameters.

The first connector plate 108 is provided with an aperture 120 extending therethrough (FIG. 6); and the second connector plate 110 is provided with an aperture 122 extending therethrough (FIG. 6A). The apertures 120 and 122 are aligned and the aperture 120 formed in the first connector plate 108 is sized to receive a portion of a shank 124 of a locking member 126 while permitting a threaded distal end portion 128 of the shank 124 to extend therethrough; and the aperture 122 formed in the connector plate 110 is sized to permit at least a portion of the threaded distal end portion 128 of the shank 124 to extend therethrough for threadable engagement with a nut 130 as will be described in more detail herein after.

The locking member 126 is also provided with a knob 134 which is connected to the shank 124 whereby the locking member 126 can be selectively rotated in a clockwise direction when securing the threaded distal end 128 of the locking member 126 to the nut 130, and thus the first and second connector plates 108 and 110 to the nut 130, and whereby the locking member 126 can be selectively rotated in a counter clockwise direction when disconnecting the threaded distal end 128 of the locking member 126 from the nut 130, and thus the first and second connector plates 108 and 110 from the nut 130, or for loosening the first and second connector plates 108 and 110 so that the first and second connector plates 108 ands 110 can be rotated so as to alter the position of the pole 102 supported within the passageway 116 of the elongated housing 106 relative to the supporting structure to which the clamp assembly 100 is connected.

The clamp assembly 100 further includes a substantially c-shaped clamp 136 having an open end portion 138 and a closed end portion 140. The substantially c-shaped clamp 136 can be connected, via the open end portion 138, to a supporting member, such as the support or brace 104 of a canoe (FIG. 3), or the upwardly extending support member 104A (FIG. 4) or the horizontally disposed support member 104B (FIG. 5). Connected in close proximity to the closed end portion 140 of the c-shaped clamp 136 is a tubular-shaped housing 142 defining a passageway 144 therethrough substantially as shown. The tubular-shaped housing 142 is sized to receive a friction plate 145 of the nut 130 and to engage a shoulder 146 of the nut 130 formed about the friction plate 145. Thus, the friction plate 145 is adapted to extend into the passageway 144 defined by the tubular-shaped housing 142.

In order to stabilize the first and second connect plates 108 and 110 on the friction plate 145 formed on the nut 130, the second connector plate 110 is provided with a friction bushing plate 147 adapted to matingly engage the friction plate 145 formed on the nut 130 so as to enhance a secure connection between the first and second connector plates 108 and 110 and the nut 130 when same are connected utilizing the locking member 126.

The nut 130 is provided with substantially centrally disposed threaded bore 148 adapted to receive the threaded distal end portion 128 of the locking member 126 for securing the first and second connector plates 108 and 110, and thus the elongated housing 106 to the c-shaped clamp 136 when the friction plate 145 formed on the nut 130 is disposed within the passageway 144 of the tubular-shaped housing 142 and the friction bushing plate 147 on the second connector plate 110 is matingly engaged therewith and the threaded distal end portion 128 of the locking member 126 is threadably engaged with the threaded bore 148 of the nut 130.

The c-shaped clamp 136 is provided with a first cantilever 150 pivotally connected to a first side 152 of the c-shaped clamp 136 so as to be disposed in the open end portion 138 of the c-shape clamp 136; and the c-shaped clamp 136 is provided with a second cantilever 154 is pivotally connected to an opposed second side 156 of the c-shaped clamp 136 so as to be disposed in the open end portion 138 of the c-shape clamp 136 and aligned with the first cantilever 150. The first side 152 of the c-shaped clamp 136 is provided with an aperture 157 positioned between the tubular-shaped housing 142 and the first and second cantilevers 150, 154 substantially as shown. A spacer member 158 is provided with a body portion 160 having a first end 162, and second end 164 and a nipple 166 extending from the first end 162. The nipple 166 is provided with a diameter less than the diameter of the body portion 160 of the spacer member 158 so as to provide a shoulder 168 therebetween. The body portion 160 is also provided with a threaded bore 170 extending inwardly from the second end 164 of the body portion 160. The nipple 166 is sized to be positioned within the aperture 157 formed in the first side 152 of the substantially c-shaped clamp 136 so that the spacer member 158 can be secured to the first side 152 of the c-shaped clamp 136 via a lock nut 172 disposed on the nipple 166 of the body portion 160 of the spacer member 158. Thus, the spacer member 158 can be secured in a stable position between the first and second sides 152 and 156 of the c-shape clamp 136.

In order to connect the c-shaped clamp 136, and thus the first and second connector plate 108 and 110 and the elongated housing 106 to a supporting object, the second side 156 of the c-shaped clamp 136 is provided with an elongated opening 174 therein, the elongated opening 174 being aligned with the aperture 157 formed in the first side 152 of the c-shaped clamp 136. The elongated opening 174 permits a locking member 176 to be operably connected to the spacer member 158 and thus the first side 152 of the c-shaped clamp 136. The interconnection of the locking member 176 and the spacer member 158 permits one to vary the distance between the first and second cantilevers 150 and 154 and thus the open end portion 138 of the c-shape clamp 136 so as to ensure that the c-shaped clamp 136 can be securely connected to a supporting struture.

The locking member 176 is provided with a shank 178, a knob 180 connected to one end of the shank 178. The shank 178 is further provided with a threaded distal end portion 182 adapted to threadingly engage the threaded bore 170 of the body portion 160 of the spacer member 158 when the shank 178 of the locking member 176 is disposed through the elongated opening 174 in the second side 156 of the c-shaped clamp 136. Thus, when selectively rotating the knob 180 of the locking member 176 in a clockwise direction, the threaded distal end portion 182 of the shank 178 engages the threaded bore 170 in the body portion 160 of the spacer member 158 whereby the first and second cantilevers 150 and 154 are caused to move towards one another and engage the opposed surfaces of the support member to which the c-shaped clamp 136 is to be connected. Upon continued clockwise movement of the knob 180 the c-shaped clamp 136 can be securely connected the support member.

When removing the c-shaped clamp 136 from the support member, the knob 180 is moved in a counter clock direction which backs the threaded distal end portion 182 of the shank 178 outward from the threaded bore 170 of the spacer member 158 whereby the distance between the first and second cantilevers 150 and 154 is increased so that the c-shaped clamp 136 can be the removed from supporting engagement with the support member.

Although the invention has been described in connection with a preferred embodiment, it will be understood that it is not intended to limit the invention to that embodiment. On the contrary, it is intended to cover all alternatives, modifications and equivalents as may be included within the spirit and scope of the invention as defined in the appended claims.

What is claimed is:

1. A clamp assembly for adjustably attaching a pole to a frame, the clamp assembly comprising:

an elongated housing having a first end, a second end and a passageway for receiving the pole, the passageway extending between the first end and the second end of the elongated housing;

a first connector plate, a second connector plate and a slit, the slit in open communication with the passageway of the elongated housing for adjusting a diameter of the passageway of the elongated housing, the first connector plate extending outwardly from the elongated housing and disposed along a first side of the slit and the second connector plate extending outwardly from the elongated housing disposed along an other side of the slit;

a mounting plate for attaching the elongated housing to the frame; and a locking member for adjustably attaching the elongated housing, the first connector plate and the second connector plate to the mounting plate.

2. The. clamp assembly of claim 1 wherein mounting plate includes at least one aperture and at least one screw for securing the mounting plate to the frame.

3. The clamp assembly of claim 1 wherein the first connector plate includes a aperture and the second connector plate includes an aperture, the first connector plate aperture and the second connector plate aperture aligned and sized to receive at least a portion of the locking member.

4. The clamp assembly of claim 3 further including a friction plate supported on the mounting plate, the friction plate having a threaded bored aligned with the first connector plate aperture and the second connector plate aperture and wherein the locking member further includes a threaded distal end portion for threadable engagement with the threaded bore of the friction plate.

5. The clamp assembly of claim 4 wherein the locking member includes a shank and a knob connected to a shank for rotating the locking member clockwise or counter clockwise.

6. The clamp assembly of claim 5 further including a friction bushing plate extending about the second connector plate aperture sized and configured to matingly receive the friction plate so as to enhance the connection between mounting plate and the second connector plate.

* * * * *

UNITED STATES PATENT AND TRADEMARK OFFICE

CERTIFICATE OF CORRECTION

PATENT NO. : 7,229,060 B2
APPLICATION NO. : 11/057655
DATED : June 12, 2007
INVENTOR(S) : Arthur Roy Collins It is certified that error appears in the above-identified patent and that said Letters Patent is hereby corrected as shown below:

Column 2, line 44: Delete “trhreaded” and replace with -- threaded -- .

Signed and Sealed this

Twenty-eighth Day of August, 2007

JON W. DUDAS
*Director of the United States Patent and Trademark Office*